United States Patent [19]

Alexandrov

[11] Patent Number: 4,906,960

[45] Date of Patent: Mar. 6, 1990

[54] DISTRIBUTION TRANSFORMER WITH COILED MAGNETIC CIRCUIT

[75] Inventor: Nicolai Alexandrov, St. Bruno, Canada

[73] Assignee: Hydro-Quebec, Montreal, Canada

[21] Appl. No.: 284,770

[22] Filed: Dec. 12, 1988

Related U.S. Application Data

[63] Continuation of Ser. No. 3,367, Jan. 14, 1987, abandoned, which is a continuation of Ser. No. 632,065, Jul. 18, 1984, abandoned.

[30] Foreign Application Priority Data

Apr. 3, 1984 [CA] Canada ..... 451156

[51] Int. Cl.[4] ..... H01F 27/10; H01F 27/26

[52] U.S. Cl. ..... 336/60; 29/606; 336/62; 336/96; 336/212; 336/213

[58] Field of Search ..... 336/60, 61, 62, 96, 336/205, 174, 213, 218, 212, 215, 223, 232; 29/605, 606

[56] References Cited

U.S. PATENT DOCUMENTS

| | | | |
|---|---|---|---|
| 2,246,240 | 6/1941 | Brand | 336/213 X |
| 2,314,912 | 3/1943 | Troy | 336/215 X |
| 2,412,345 | 12/1946 | Lindenblad | 336/174 X |
| 2,490,506 | 12/1949 | Broverman | 336/213 X |
| 3,018,455 | 1/1962 | Brandon, Jr. et al. | 336/213 X |
| 3,437,965 | 4/1969 | Ragsdale | 336/61 |
| 3,617,965 | 11/1971 | Trench et al. | 336/61 |
| 3,617,966 | 11/1971 | Trench et al. | 336/61 |
| 3,621,425 | 11/1971 | Trench | 336/61 |
| 3,693,126 | 9/1972 | Rybak | 336/61 |
| 3,913,045 | 10/1975 | Von Starck | 336/61 |
| 3,960,803 | 6/1976 | Smith et al. | 336/205 X |
| 4,488,135 | 12/1984 | Schwartz | 336/62 |
| 4,528,481 | 7/1985 | Becker et al. | 336/218 X |

FOREIGN PATENT DOCUMENTS

| | | | |
|---|---|---|---|
| 26871 | 4/1981 | European Pat. Off. | 336/234 |
| 1049007 | 1/1959 | Fed. Rep. of Germany | 336/62 |
| 2363874 | 10/1975 | France | 336/62 |
| 695247 | 9/1965 | Italy | 336/60 |

*Primary Examiner*—Thomas J. Kozma

*Attorney, Agent, or Firm*—Burns,Doane, Swecker & Mathis

[57] ABSTRACT

A distribution transformer and a method of making same. The transformer has at least one closed magnetic circuit in the form of a hollow toroidal coil made from ferro-magnetic steel ribbon. An electric circuit is formed by a primary winding and a secondary winding each constituted by one or more sub-assemblies in the form of a double pancake. These double pancakes are juxtaposed and molded together in a solid insulating material to form a rigid insulating frame on which the magnetic circuit is wound to form one or more magnetic coils. The rigid insulating frame, which is constituted by the primary and secondary windings and the insulating material, also includes therein conduits capable of circulating a cooling fluid through the windings whereby to provide heat exchange to cool the assembly of the electrical and magnetic circuits.

19 Claims, 3 Drawing Sheets

DISTRIBUTION TRANSFORMER WITH COILED MAGNETIC CIRCUIT

This application is a continuation of application Ser. No. 003,367, filed Jan. 14, 1987 now abandoned, which is a continuation of application Ser. No. 632,065, filed July 18, 1984 now abandoned.

BACKGROUND OF INVENTION (a) Field of the Invention

The present invention relates to a new type of distribution transformer in which the electric circuit is constituted by two or more sub-assemblies in the form of double pancakes which are juxtaposed and molded together in an insulating material whereby to form a rigid insulating frame which is cooled internally by heat exchange tubes in which circulates a cooling fluid, and wherein on one or more of the legs of the frame there is wound a magnetic circuit which is formed by one or more toroidal coils made from ribbon of ferro-magnetic material with the magnetic circuit also being cooled by the cooling fluid that circulates inside the frame.

(b) Description of Prior Art

Conventional distribution transformers are used to step down the electrical voltage at various user locations on a power distribution line. The conventional power transformer, as presently known, consists essentially of a magnetic circuit having a metal core formed from a plurality of thin superimposed plates disposed parallel and connected to each other. Nowadays, almost exclusively, these plates are crystal-oriented and hence have a strong anisotropic structure. Further, these plates exhibit a high performance in their laminated direction but have magnetic characteristics that are very mediocre in the direction transverse to the lamination. The primary and secondary windings of such distribution transformers are metallic conductors, for example insulated copper wires having a circular or rectangular cross-section, wound in a bobbin about one or more of the legs of the magnetic core or frame. The electrical voltage applied to the primary winding of these distribution transformers is of the order of several kilovolts but can go as high as tens of kilovolts, whereas the voltage appearing at the terminal ends of the secondary winding is of the order of a few hundred volts.

The range of known distribution transformers extends from a few kVA to about 300 kVA. The magnetic and electric circuits are immersed in a mineral oil which is contained in a metal transformer housing. This oil serves as an insulator and also participates in the cooling of the transformer. The major disadvantages of such conventional distribution transformers are set forth below.

1. Prior art distribution transformers being immersed in an oil that is inflammable are vulnerable to fire or explosion in the event of defects or over-heating of the transformer, and furthermore, the weight of such oil represents approximately 25% of the total weight of the transformer, excluding the housing and the terminals.

2. The concept of prior art distribution transformer is such that it is impossible to eliminate "hot points" which accelerate the aging of the oil and all of the electrical insulation in the transformer construction.

3. The concept of prior art distribution transformers is such that it is impossible to completely utilize the anisotropy of the crystal-oriented plates forming the magnetic circuit.

4. The oil-air heat exchangers on the transformer housing for the cooling of the oil inside the housing are not very effective.

5. Prior art distribution transformers also are characterized by energy losses arising from hysteresis and Foucault currents, these losses being continuous and relatively large.

SUMMARY OF INVENTION

A feature of the distribution transformer of the present invention is to totally or partially eliminate the above-mentioned disadvantages of prior art distribution transformers.

A further feature of the present invention consists in providing a new distribution transformer having an electric circuit formed by primary and secondary windings, each being constituted by one or more sub-assemblies in the form of double pancakes.

A "pancake" is defined herein as consisting of a flat coil formed by a certain number of spiral turns of an insulated electrical wire and a "sub-assembly" is defined herein as constituted by two of these flat coils being formed by a single wire which is uninterrupted.

These sub-assemblies are juxtaposed in an insulated manner and molded together in a solid insulating material that infiltrates the interstices whereby to form a rigid insulating frame on which is wound the magnetic circuit.

Another feature of the present invention consists in the provision of a new distribution transformer wherein the cross-section of the electrical circuit and its insulating material can be circular or have any other shape.

Another feature of the present invention consists in the provision of a new distribution transformer wherein the insulation of the conductors forming the primary and secondary windings as well as the insulation forming the rigid insulating frame are not subjected to wear due to vibrations caused by electromagnetic forces acting on the electrical conductors of the transformer.

Another feature of the present invention consists in the provision of a new distribution transformer which does not utilize an oil-air heat exchanger to cool the oil, and wherein the terminals of the windings are connected directly to connectors which are molded with the rigid insulating frame.

Another feature of the present invention consists in the provision of a new distribution transformer having a molded electrical frame wherein all of the insulating materials and molding material of the transformer are thermally stable to temperatures in the order of 220° C. or more.

Another feature of the present invention consists in the provision of a new distribution transformer wherein the windings are insulated from one another by flat rigid or flexible insulating sheets which are disposed between the primary and secondary windings and also between the sub assemblies.

Another feature of the present invention consists in the provision of a new distribution transformer wherein there are embedded in the rigid insulating frame cooling plates and/or heat exchange tubes for circulating a cooling fluid through the insulating frame.

Another feature of the present invention consists in the provision of a new distribution transformer in which the insulation of the electric circuit, the molding material, as well as all other structural elements of the transformer are substantially nonflammable.

Another feature of the present invention consists in the provision of a new distribution transformer having a magnetic circuit formed from at least one hollow coil made of ferro-magnetic steel ribbon wound about one or more legs, of circular or non-circular cross-section, of the rigid insulating frame.

Another feature of the present invention is to provide a new distribution transformer wherein the magnetic circuit is a spirally wound ferro-magnetic steel ribbon, thus permitting almost complete utilization of the anisotropy of the crystal-oriented sheets since the direction of the lamination of these sheets corresponds to the direction of the magnetic flux in each of the magnetic coils.

Another feature of the present invention consists in the provision of a new distribution transformer in which the weight of the magnetic circuit is approximately 70% of the total weight of the magnetic circuit of prior art transformers having the same power capabilities.

Another feature of the present invention consists in the provision of a new distribution transformer in which the electrical losses in the magnetic circuit are minimized as well as the total weight of the magnetic circuit and permitting substantially total use of the anisotropy of the crystal-oriented metal sheet.

According to another feature of the present invention there is provided a new distribution transformer wherein the magnetic circuit is constituted by one or more coils formed from an amorphous steel ribbon, for example, of the METGLAS 2605 S-2 type. When utilizing amorphous steel the coils are wound about a rigid frame constituted by the primary and secondary windings and incorporating therein cooling plates and/or conduits, and are thermally and magnetically treated and thereafter molded in insulating material, for example elastomeric material charged with silicon oxide grains.

Another feature of the present invention is to provide a new distribution transformer incorporating a magnetic circuit formed by one or more hollow coils made of amorphous steel, each of the coils being disposed on an insulating horizontal plate which serves as a support, the mechanical load on each support being independent of the mechanical load applied to the other supports. The axis of the coil being vertical, no clamping and/or fixing elements are required, this resulting in a reduction of magnetic losses due to mechanical stresses arising from the effect of the mechanical forces developed by the clamping and fixing elements of conventional transformers.

Another aspect of the present invention consists in the provision of a new distribution transformer in which the magnetic circuit requires no fixing or clamping elements and no metallic housing, all of which are electroconductive, and accordingly, loss in energy resulting from the use of such elements is eliminated.

According to a further aspect of the present invention there is provided a method of fabricating a distribution transformer of the type having an electric circuit and a cooling system both of which are molded in a rigid insulating frame and wherein, on one or more of the legs of this frame, a magnetic circuit is provided by one or more coils formed by a toroidal winding of a steel band or ribbon having an oriented crystal structure or formed of an amorphous steel or other type of metal having a high relative magnetic permeability. The method comprises the following steps: (i) forming primary and secondary windings by winding electrically insulated conductive wires; (ii) forming double wire pancakes by coiling a wire into two flat spiral coils, the two flat coils being insulated from each other by a flat insulating sheet and each double pancake forming a sub-assembly of the primary or secondary windings and being similarly insulated from adjacent double pancakes and cooled by cooling plates or conduits disposed therein; (iii) the double pancakes of the primary and secondary windings and sometimes the cooling plates or tubes are juxtaposed while ensuring good electrical insulation between all of the sub-assemblies, and the double pancakes of the primary and secondary windings are interconnected; (iv) the double pancakes of the primary and secondary windings and the cooling plates or tubes are then molded in a suitable insulating material to form a rigid frame; and (v) a flat ribbon of steel having an oriented crystal structure or made of amorphous steel is wrapped about at least one of the legs of the rigid insulating frame formed by the primary and secondary winding and the cooling element.

BRIEF DESCRIPTION OF DRAWINGS

A preferred embodiment of the present invention will now be described with reference to the examples thereof as illustrated in the accompanying drawings, in which.

Figure 1:
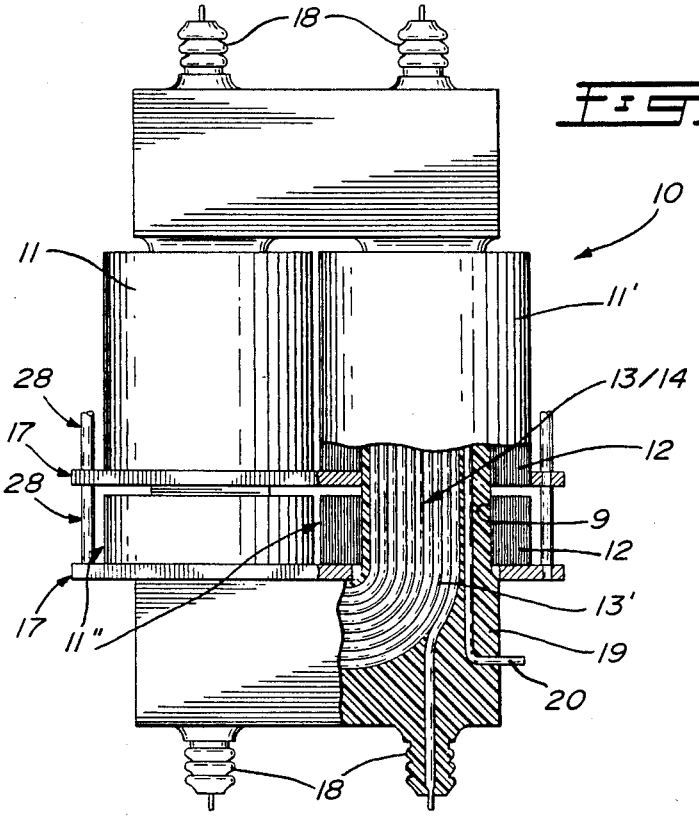
FIG. 1 is a side view of the distribution transformer of the present invention partly sectioned to illustrate the construction of the transformer.
Figure 2:
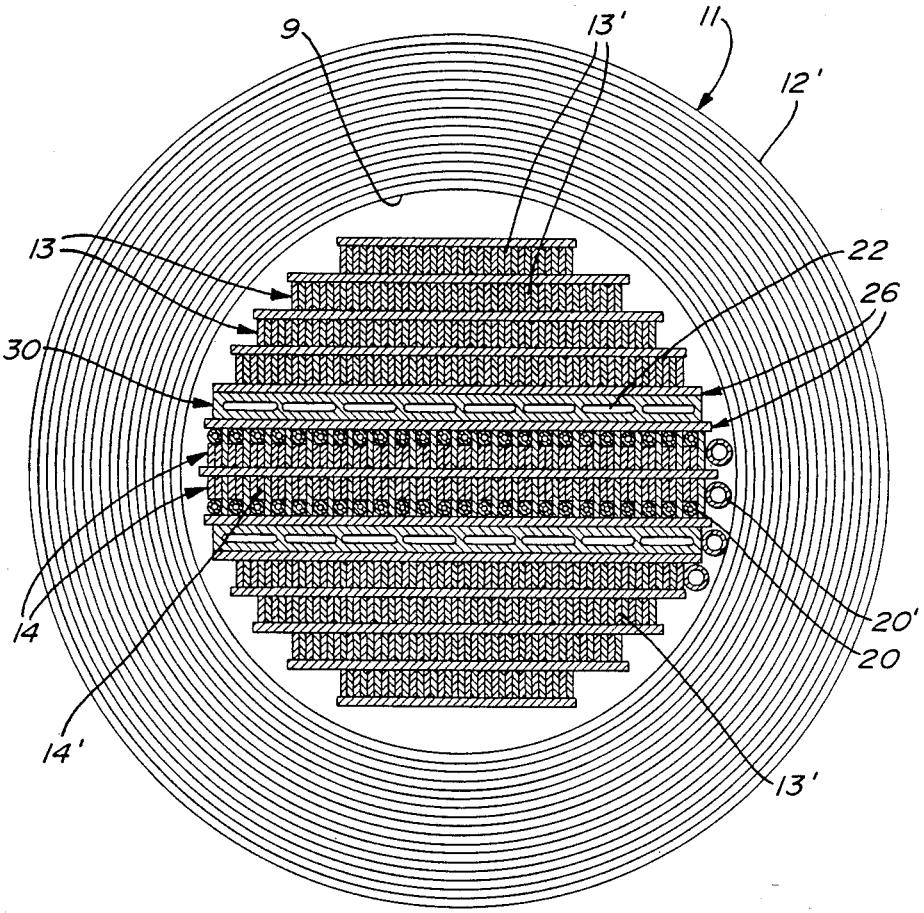
FIG. 2 is a cross-section view through the electric and magnetic circuits.

DESCRIPTION OF PREFERRED EMBODIMENTS:

Referring now to the drawings, and more particularly to FIGS. 1 and 2, there is shown generally at 10 the distribution transformer of the present invention. The transformer 10 comprises a magnetic circuit formed by at least one, two in the present case, hollow coils 11 and 11' formed by a ribbon of ferro-magnetic steel which is coiled or wound to form the magnetic circuit. As shown in FIG. 1, the coils 11 and 11' may be formed in sections, and then each pair of coils 11'' is disposed on support plates 17 which are interconnected by connecting rods 28. An electric circuit is formed by primary and secondary windings 13 and 14, each constituted by a plurality of loops 13' and 14' of an insulated conductor, with each loop passing through the interior 9 of the coils 11 and 11'.

Figure 7:
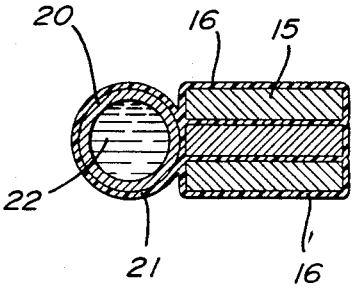
FIG. 7 is a cross-section view showing the heat exchanger conduit disposed in the secondary winding.

The primary and secondary windings 13 and 14 are made from a flat insulated electrical conductor having a generally rectangular cross-section, as can be seen at 15 in FIG. 7, and covered with an electrically insulating sheath 16. Dry insulation, in the form of flat electrically insulating sheets 26, insulates the primary winding from the secondary winding and also the cooling means 30. The electrical conductors forming these primary and secondary windings also have a predetermined cross-section and configuration depending on the power requirement of the transformer to be constructed. The ends of these windings are connected to transformer terminals. The entire primary and secondary windings are impregnated with an insulating material 19, herein an epoxy resin, or an elastomeric material or other insulating materials which also constitute the connection terminals 18. The insulating material 19 penetrates all the interstices of the primary and secondary winding assembly and the interior space 9 of the magnetic coil circuit. As illustrated in FIG. 1, hollow coils 11 and 11' are disposed side by side on opposed sides or legs of the loop formed by the primary and secondary windings located at the interior of the rigid insulated molded frame passing through the interior of the magnetic circuit coils.

The steel ribbon 12' constituting the magnetic circuit 12 may be constructed of silicon steel having an oriented crystal structure or amorphous steel, such as METGLAS 2605 S-2.

As illustrated in the cross-section view of FIG. 2, cooling means in the form of heat exchange conduits 20, 20' and 30 may be disposed within the primary and secondary windings and thus pass through the interior of the hollow coils 11 and 11' whereby to extract heat generated by these coils. The heat exchange conduit 20 may be disposed at the interior of the coils forming the secondary winding as shown in FIG. 1. The cooling fluid circulating through the conduit extracts the heat from the primary and secondary windings. As shown in FIG. 7, the heat exchange conduit 20 may also be made as an electrical conductor and form an integral part of the secondary winding. This cooling conductor would also be provided with an electrically insulating sheath. The cooling fluid 22 which circulates in the conduit may be any convenient cooling fluid.

Figure 5:
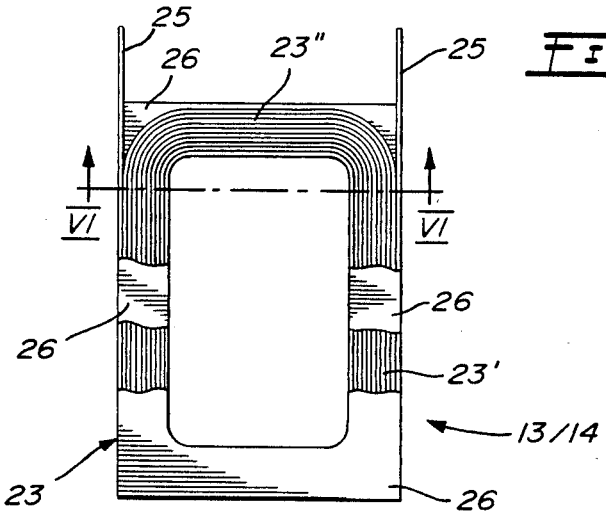
FIG. 5 is a side view, partly fragmented, illustrating the construction of the double pancake constituting the primary or secondary winding.
Figure 6:
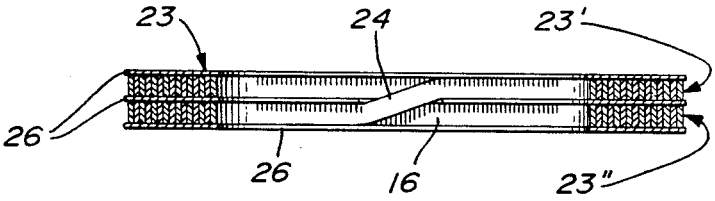
FIG. 6 is a cross-section view along cross-section line VI—VI of FIG. 5 illustrating the construction of the double pancakes.

Referring now to FIGS. 5 and 6, there is shown the construction of double pancakes forming a sub assembly of the primary or secondary winding 13 or 14. Although this is a preferred form of the double pancakes, the invention is not limited to this aspect. As shown, each double pancake 23 consists of two single pancakes 23' and 23", each wound from ordinary flat electrical conducting wire 16. Each single pancake 23' and 23" is wound in opposed directions thus forming a cross-over junction 24 at the interior of the windings as shown in FIG. 6 and two terminal ends 25 at the exterior of the windings forming each single pancake as illustrated in the fragmented section of FIG. 5. A flat sheet 26 of electrically insulating material is disposed on each side of the single pancake to insulate one pancake from the other and to insulate the double pancakes from adjacent ones and to insulate the double pancakes from adjacent cooling plates 30 in the event that these plates are not made of electrically insulated material.

Figure 8:
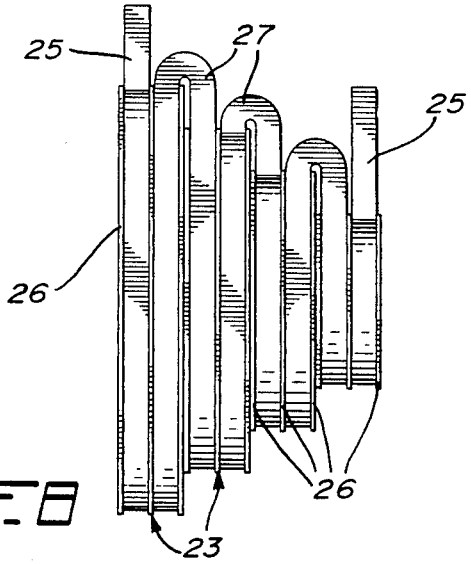
FIG. 8 is a side view illustrating a plurality of double pancakes interconnected to constitute the primary or secondary windings.

If it is necessary to have a primary or secondary winding consisting of a number of double pancakes 23, it suffices simply to interconnect the terminal ends 25 of adjacent windings, as illustrated in FIG. 8, these connections being identified by the reference numeral 27. Furthermore, as illustrated in FIG. 8, and in the cross-section of FIG. 2, the wound pancakes may be of different configurations which permit, for example, the fabrication of primary and secondary windings having a pyramidal shape in order to occupy as much of the space as possible in the interior 9 of the magnetic coils 11, 11'. Furthermore, each torus of a group of two tori wound on the legs of the frame may have a different outer configuration, such as is illustrated in FIGS. 3 and 4, thus permitting the construction of transformers which are more compact.

Figure 3:
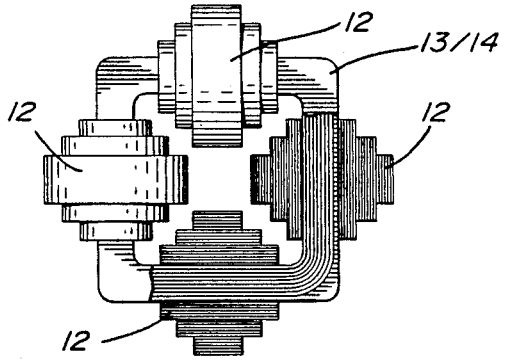
FIG. 3 is a schematic illustration of another shape of construction of the distribution transformer of the present invention.
Figure 4:
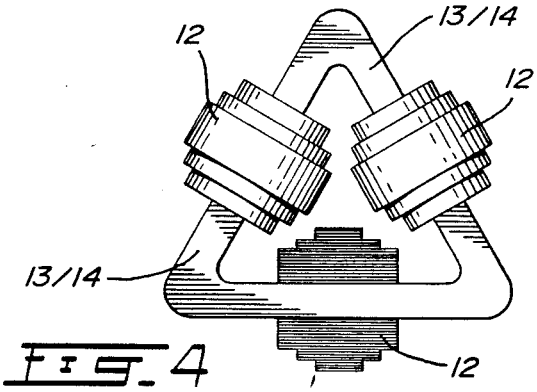
FIG. 4 is a further schematic illustration of a still other shape of construction of the distribution transformer of the present invention.

Referring now to FIG. 3, there is illustrated a different shape of transformer where the magnetic circuit is constituted by superposing in the coil layers of steel ribbon 12 of which the width diminishes in the direction of the outer periphery of the magnetic circuit whereby to occupy as much as possible the interior space of the primary and secondary coils 13 and 14 forming the electric circuit and frame.

We will now describe the method of constructing the distribution transformer of the present invention. Generally, the method comprises forming the primary and secondary windings 13 and 14 by winding an electrically insulated conductor and by juxtaposing the primary and secondary windings with a proper electrically insulating material disposed therebetween. One or more flat cooling plates or conduits are juxtaposed with the pancakes forming the primary and secondary windings. These juxtaposed windings and cooling plates or conduits are then molded in an insulating material which becomes solid, and a ferro-magnetic steel ribbon is then wound about at least one leg of the rigid insulated frame formed by the primary and secondary windings and the cooling plates or conduits whereby to form a magnetic circuit.

If the ferro-magnetic steel ribbon is a ribbon of amorphous steel, after the magnetic circuit is wound about the rigid insulating frame containing the primary and secondary windings, this ferro-magnetic steel ribbon is heat treated in an oven and subjected to a magnetic treatment in order to improve the magnetic property of the amorphous steel and to reduce the hysteresis losses and Foucault current losses to a minimum. If the ferro-magnetic steel ribbon is made of silicon steel having an oriented crystal structure, the ribbon is reheated before being wound on the rigid insulating frame which contains the primary and secondary windings and the cooling plates or conduits.

The thermal treatment of the magnetic circuit when formed of silicon steel having oriented crystals comprises many steps. At the beginning, the steel ribbon is wound on a steel mandrel with a cross-section which is substantially the same as that of the rigid insulating frame where the coil will be wound. The steel ribbon which is wound on this mandrel is then submitted to a heat treatment in order to improve the magnetic properties of the steel. Thereafter, it is cooled and the ribbon is unwound and rewound on another similar mandrel. After another unwinding, the ribbon is transferred to a section of the rigid insulating frame in such a way as to remove the mechanical forces or stresses in the ribbon which would degrade the ferro-magnetic properties of the magnetic circuit and which would increase the losses due to hysteresis or Foucault currents.

The winding of the primary and secondary windings is described sufficiently in detail hereinabove with reference to FIG. 5 and will not be repeated. Also, the manner in which the heat exchange conduits or plates are disposed at the interior of the electric circuit is sufficiently described hereinabove and will not be repeated.

It is within the ambit of the present invention to cover any obvious modifications of the examples of the preferred embodiment described herein provided such modifications fall within the scope of the appended claims.

I claim:

1. A distribution transformer comprising an electric circuit formed by primary and secondary windings electrically insulated from one another and constituted by at least two sub-assemblies insulated between each other and juxtaposed and retained together to form a rigid insulating frame, cooling means disposed at the interior of said rigid frame for circulating cooling liquid fluid, and a magnetic circuit wound about at least one section of the rigid frame, said magnetic circuit being constituted by at least one hollow coil of superimposed layers of a ferromagnetic flat metallic ribbon consisting of one of silicon steel having an oriented crystal structure and amorphous steel and having a high relative magnetic permeability, and means including a plate upon which said coil rests to support the weight of said coil on a wound edge with its axis oriented vertically to thereby substantially eliminate mechanical stresses on said layers of metallic ribbon.

2. A distribution transformer according to claim 1 wherein each of said sub-assemblies is in the form of a double pancake.

3. A distribution transformer according to claim 2 characterized in that the said double pancakes are molded together in an insulating material forming the said rigid insulating frame.

4. A distribution transformer according to claim 3 characterized in that the said cooling means is constituted by conduits disposed within the double pancakes and molded therein and in which a cooling fluid is circulated, the said magnetic circuit also being cooled by said fluid circulated through said conduits.

5. A distribution transformer according to claim 1 characterized in that there are provided two of said hollow coils disposed side by side on opposed sides of said insulating frame with said sides extending in the spaces of said hollow coils.

6. A distribution transformer as claimed in claim 1 wherein said ribbon having a high relative magnetic permeability has been subjected to thermal treatment to diminish losses caused by at least one of hysteresis and Foucault currents.

7. A distribution transformer as claimed in claim 1 characterized in that each of said primary and secondary windings is constituted by at least one sub-assembly in the form of a double pancake, said double pancake consisting of an insulated conductor which is wound to form two single pancakes each with a wire coiled in opposed directions and having an intermediate crossover junction which is located at the interior of the windings and wherein two terminal wire ends are disposed at the exterior of said windings, all the single pancakes being insulated from each other by a flat electrically insulating sheet forming a frame with the same geometry as the pancakes themselves, and each said double pancake being made from a single conductive electrically insulated wire.

8. A distribution transformer according to claim 1 characterized in that said cooling means is disposed at the interior of the rigid insulating frame containing the primary and secondary windings and juxtaposed to said primary and secondary windings in order to remove heat generated by said windings.

9. A distribution transformer according to claim 8 characterized in that said cooling means is constituted by heat exchange conduits in which there is circulated a suitable cooling liquid to extract heat from said primary and secondary windings that are molded together and further to extract heat from said magnetic circuit which is wound about legs of said frame containing said primary and secondary windings.

10. A distribution transformer according to claim 9 characterized in that said heat exchange conduits are hollow conductors which are integrally attached to said secondary winding.

11. A distribution transformer according to claim 9 characterized in that said heat exchange conduits are in the form of cooling plates having conduits therein and having the same shape as double pancakes forming the primary and secondary windings, these cooling plates being juxtaposed with the primary and secondary windings whereby to prevent local overheating.

12. A distribution transformer according to claim 1 characterized in that said primary and secondary windings have insulating sheaths thereon, said primary and secondary windings and all insulating sheaths of said windings are molded in a solid electrically insulating material whereby to prevent them from being subjected to wear due to vibrations generated by the electro-magnetic forces acting on said electrical circuit.

13. A distribution transformer according to claim 1 characterized in that said transformer is provided with connectors which are molded in the rigid insulating frame, said primary and secondary windings having terminal ends connected to said connectors.

14. A distribution transformer according to claim 1 characterized in that said insulating frame is molded of a molding material and that said sub-assemblies are insulated by an electrically insulating material having a thermal stability characteristic of substantially 220° C.

15. A distribution transformer according to claim 14 characterized in that said transformer is substantially nonflammable.

16. A distribution transformer according to claim 1 wherein said coil is wound about said section of said rigid insulating frame constituted by the electrical windings and the cooling means are molded together in an electrically insulating molding material.

17. The distribution transformer of claim 1 wherein said magnetic circuit comprises at least two of said coils located vertically one above the other along said section of said frame, each of said coils being supported on a respective plate so that the weight of the higher coil does not exert any forces on the lower coil.

18. A distribution transformer as claimed in claim 1, wherein said flat metallic ribbon is silicon steel having an oriented crystal structure and which is the product of the treatment comprising the steps of winding, heating, unwinding and rewinding said ribbon.

19. A distribution transformer as claimed in claim 1, wherein said flat metallic ribbon is amorphous steel which has been subjected to the treatment comprising the steps of heating and magnetic treatment.

* * * * *